US008245332B2

(12) United States Patent
Yul et al.

(10) Patent No.: US 8,245,332 B2
(45) Date of Patent: Aug. 21, 2012

(54) COLLAPSIBLE BED ASSEMBLY

(75) Inventors: Lee Pil Yul, Fujian (CN); Huang Chang Jiu, Fujian (CN)

(73) Assignee: North Pole Limited, Kowloon (HK)

( * ) Notice: Subject to any disclaimer, the term of this patent is extended or adjusted under 35 U.S.C. 154(b) by 126 days.

(21) Appl. No.: 12/129,388

(22) Filed: May 29, 2008

(65) Prior Publication Data

US 2008/0295246 A1 Dec. 4, 2008

(30) Foreign Application Priority Data

May 29, 2007 (CN) ..... 2007 2 0007247 U

(51) Int. Cl.
*A47C 17/64* (2006.01)

(52) U.S. Cl. ..... 5/114; 5/12.2; 5/111; 5/174

(58) Field of Classification Search ..... 5/112, 114, 5/115, 178–180, 182, 184, 185, 8, 12.2, 43, 5/37.1, 39, 110, 111, 174, 411, 200.1, 201, 5/202; 297/233, 240, 243, 248, 354.13, 440.1, 297/440.14, 440.15, 19, 22, 34, 452.2; 108/6, 108/11, 56.1, 162, 118, 64, 70, 78, 166, 167, 108/168, 171, 172, 173, 179, 185, 186, 188, 108/134, 135, 155, 159.11, 158.11, 158.12
See application file for complete search history.

(56) References Cited

U.S. PATENT DOCUMENTS 675,519 A * 6/1901 McDonnell ..... 5/148
2,825,594 A 3/1958 Hatchette
3,221,348 A * 12/1965 Siegel ..... 5/28
3,225,363 A * 12/1965 Kirsch ..... 5/55.1
3,949,434 A * 4/1976 Anacker ..... 5/12.1
4,846,204 A * 7/1989 Sok Kyu ..... 5/113
6,446,282 B1 * 9/2002 Wu ..... 5/115
6,564,402 B1 5/2003 Lin
7,114,205 B2 * 10/2006 Choi ..... 5/114
7,648,196 B2 * 1/2010 Degelman et al. ..... 297/45
2008/0000024 A1 * 1/2008 Peixin et al. ..... 5/112

OTHER PUBLICATIONS

An International Search Report for corresponding PCT patent application No. PCT/US2008/065157, filed May 29, 2008 (2 pages).

* cited by examiner

*Primary Examiner* — Robert G Santos
*Assistant Examiner* — Nicholas Polito
(74) *Attorney, Agent, or Firm* — Armstrong Teasdale LLP

(57) ABSTRACT

A collapsible and convertible frame assembly movable between an expanded configuration and a collapsed configuration includes a first unit including a first frame having a plurality of first scissor assemblies each including a first frame member pivotally coupled to a second frame member at a pivot point. Frame members of adjacent first scissor assemblies are coupled to a first upper connector assembly or a first lower connector assembly. A second unit is removably coupled to the first unit. The second unit includes a second frame having a plurality of second scissor assemblies each including a first frame member pivotally coupled to a second frame member at a pivot point. Frame members of adjacent second scissor assemblies are coupled to a second upper connector assembly or a second lower connector assembly. An assembly unit removably couples the first unit to the second unit.

20 Claims, 8 Drawing Sheets

COLLAPSIBLE BED ASSEMBLY

CROSS REFERENCE TO RELATED APPLICATIONS

This application claims the benefit of Chinese Patent Application No. 200720007247.1, filed on May 29, 2007, which is hereby incorporated by reference in its entirety.

BACKGROUND OF THE DISCLOSURE

The field of the disclosure relates generally to collapsible furniture, such as a collapsible or folding bed, and, more particularly, to a collapsible or folding bed that is convertible into a sofa.

At least one conventional collapsible furniture piece includes a gear adjustor that is positioned on a backrest that is positioned between a rear seat frame and a front seat frame such that the collapsible furniture piece is movable between a bed and a sofa. However, the gear adjustor is complicated and requires additional time and/or expense to manufacture. Additionally, such furniture piece is a unitary member and is not configured to decouple to form two or more smaller beds, as desired. Further, the conventional furniture piece is not fully collapsible and, thus, requires adequate storage space and/or is not easily portable.

BRIEF DESCRIPTION OF THE DISCLOSURE

In one aspect, a collapsible and convertible furniture assembly is provided. The collapsible and convertible furniture assembly is movable between an expanded configuration and a collapsed configuration. The collapsible and convertible furniture assembly includes a first unit including a first frame having a plurality of first scissor assemblies. Each first scissor assembly of the plurality of first scissor assemblies includes a first frame member pivotally coupled to a second frame member at a pivot point. Frame members of adjacent first scissor assemblies are coupled to a first upper connector assembly or a first lower connector assembly. A second unit is removably coupled to the first unit. The second unit includes a second frame having a plurality of second scissor assemblies. Each second scissor assembly of the plurality of second scissor assemblies includes a first frame member pivotally coupled to a second frame member at a pivot point. Frame members of adjacent second scissor assemblies are coupled to a second upper connector assembly or a second lower connector assembly. At least two support rods are coupled to the second frame. Each support rod of the at least two support rods is slidably coupled to a corresponding first frame member and has a lower end pivotally coupled to a corresponding second frame member. Each support rod is pivotally movable with respect to the corresponding second frame member.

In another aspect, a collapsible and convertible frame assembly that is movable between an expanded configuration and a collapsed configuration is provided. The collapsible and convertible frame assembly includes a first unit including a first frame having a plurality of first scissor assemblies. Each first scissor assembly of the plurality of first scissor assemblies includes a first frame member pivotally coupled to a second frame member at a pivot point. Frame members of adjacent first scissor assemblies are coupled to a first upper connector assembly or a first lower connector assembly. A second unit is removably coupled to the first unit. The second unit includes a second frame having a plurality of second scissor assemblies. Each second scissor assembly of the plurality of second scissor assemblies includes a first frame member pivotally coupled to a second frame member at a pivot point. Frame members of adjacent second scissor assemblies are coupled to a second upper connector assembly or a second lower connector assembly. An assembly unit removably couples the first unit to the second unit. In one embodiment, the assembly unit includes a first coupler operatively coupled to a corresponding first upper connector assembly or a corresponding first lower connector assembly and a second coupler operatively coupled to a corresponding second upper connector assembly or a corresponding second lower connector assembly. Alternatively or additionally, the assembly unit includes a second coupler operatively coupled to a corresponding first upper connector assembly or a corresponding first lower connector assembly and a first coupler operatively coupled to a corresponding second upper connector assembly or a corresponding second lower connector assembly.

In another aspect, a method is provided for assembling a collapsible frame assembly. The method includes forming a collapsible first frame including a plurality of first scissor assemblies. Each first scissor assembly of the plurality of first scissor assemblies includes a first frame member pivotally coupled to a second frame member at a pivot point. Frame members of adjacent first scissor assemblies are coupled to a first upper connector assembly or a first lower connector assembly. A collapsible second frame is formed that includes a plurality of second scissor assemblies. Each second scissor assembly of the plurality of second scissor assemblies includes a first frame member pivotally coupled to a second frame member at a pivot point. Frame members of adjacent second scissor assemblies are coupled to a second upper connector assembly or a second lower connector assembly. The first unit is removably coupled to the second unit.

DETAILED DESCRIPTION OF THE DISCLOSURE

The present disclosure provides a folding or collapsible and convertible furniture assembly, such as a bed assembly, including a plurality of collapsible and/or convertible units. Each unit includes a frame that forms a support structure in an expanded configuration suitable for supporting a mattress, such as an inflatable mattress, and one or more users positioned on the mattress. The units may be used independently or may be coupled together to form a larger furniture assembly. For example, in one embodiment, each unit includes a frame that supports a full size or twin size mattress. The units may be coupled together such that the mattresses form a larger mattress assembly having dimensions similar to or the same as a conventional queen size mattress. Further, in one embodiment, at least one frame is convertible in the expanded configuration between a first or bed configuration and a second or sofa configuration. Each frame is collapsible from the expanded configuration to a collapsed configuration for easy storage and/or transport. For example, in the collapsed configuration, the frames may be contained within a storage bag. When a sleeping area or a seating area is desired, one or more frames are movable from the collapsed configuration to the expanded configuration, such as the first configuration or the second configuration, respectively, for supporting a respective mattress. The mattress is positioned on and supported by the frame in the expanded configuration. In one embodiment, the mattress is removably coupled to the frame.

The present disclosure is described below in reference to its application in connection with and operation of a bed assembly having a plurality of foldable or collapsible and convertible frames. The bed assembly is convertible between the bed configuration and the sofa configuration with the frames in the expanded configuration. It should be apparent to those skilled in the art and guided by the teachings herein provided that the collapsible and convertible frame is likewise applicable to any suitable foldable or collapsible furniture piece, for example.

Figure 1:
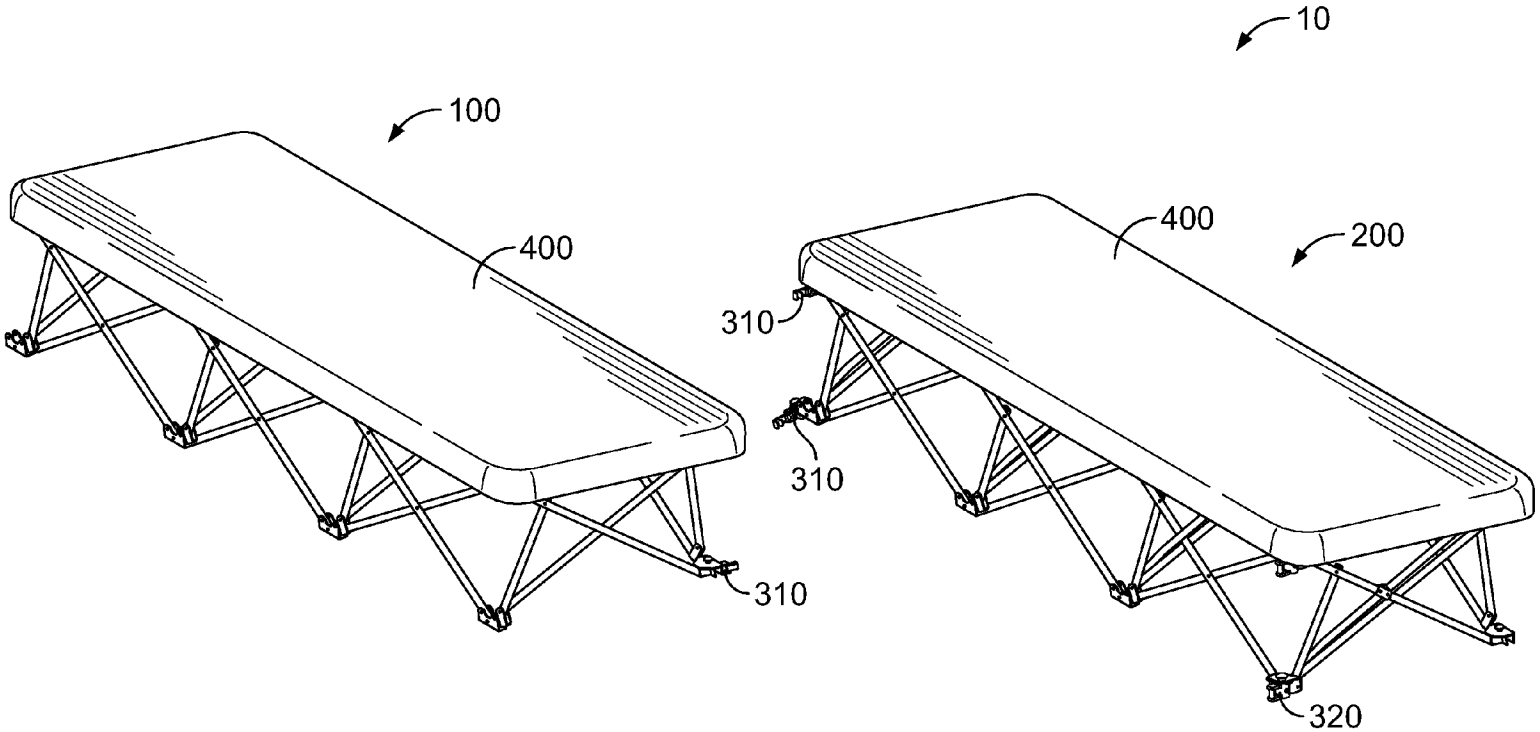
FIG. 1 is a perspective view of two units each in an expanded bed configuration.

Referring to FIGS. 1-12, a furniture assembly, such as a bed assembly 10, includes at least two independent, foldable or collapsible units. In one embodiment, a first unit 100 is removably coupled to a second unit 200 to form bed assembly 10. First unit 100 and second unit 200 are configured to support a mattress 400 in the expanded configuration, as shown in FIG. 1. In a particular embodiment, one or more assembly units 300 removably couple first unit 100 to second unit 200.

In one embodiment, each mattress 400 is removably positioned within a fabric covering that defines an enclosure having an entry that is sealed with a suitable closure mechanism or fastener, such as a zipper, buttons, snaps, hook-and-loop fastener components, such as VELCRO® fastener components, and/or hook-and-eye fastener components. (VELCRO is a registered trademark of Velcro Industries B.V.) The fabric covering may be a plastic, cloth, or leather material, for example, and encloses at least a portion of mattress 400, which is inserted into the entry.

In one embodiment, bed assembly 10 includes an inflatable mattress 400 coupled to a self-expanding first unit 100 or second unit 200. Mattress 400 is permanently or removably coupled to first unit 100 or second unit 200 directly or indirectly, such as with a fabric covering. In certain embodiments, mattress 400 and/or the fabric covering are at least partially permanently or removably coupled to first unit 100 or second unit 200 using a suitable fastener component, such as buttons, snaps, and/or hook-and-loop fastener components, such as VELCRO® fastener components. In a particular embodiment, mattress 400 is coupled, directly or indirectly, to first unit 100 or second unit 200 at a plurality of locations such that as mattress 400 is filled with air to expand, first unit 100 or second unit 200 is urged to move outwardly. In a further particular embodiment, an air pump is coupled to an inflation port on mattress 400. The air pump may be electrically operated and powered by a wall current or by batteries. Further, the air pump may include a suitable sensor configured to detect a signal transmitted by a remote control. The remote control activates and deactivates the electric pump by transmitting a corresponding signal that is detected by the sensor. Alternatively or in addition, the air pump may have a manual on-off switch. In an alternative embodiment, mattress 400 is manually inflated.

In one embodiment, first unit 100 includes a plurality of frame members joined by pivot assemblies such that lower connector assemblies move laterally within a common horizontal plane as the frame as a whole expands outwardly from a central reference area to expand first unit 100 outwardly from the central reference area. First unit 100 is urged outwardly from the central reference area, thus causing first unit 100 to expand outwardly as a whole from the central reference area and mattress 400 is inflated. In a particular embodiment, mattress 400 is coupled to first unit 100 at a plurality of attachment points such that as mattress 400 is inflated and expands outwardly, first unit 100 also expands outwardly. Mattress 400 may be coupled to first unit 100 with a fabric covering, which encloses at least a portion of mattress 400. The fabric covering is coupled to first unit 100 at a plurality of attachment points, for example at a plurality of upper connector assemblies, such that as mattress 400 is inflated and expands outwardly, the fabric covering expands outwardly, causing first unit 100 to also expand outwardly.

Figure 2:
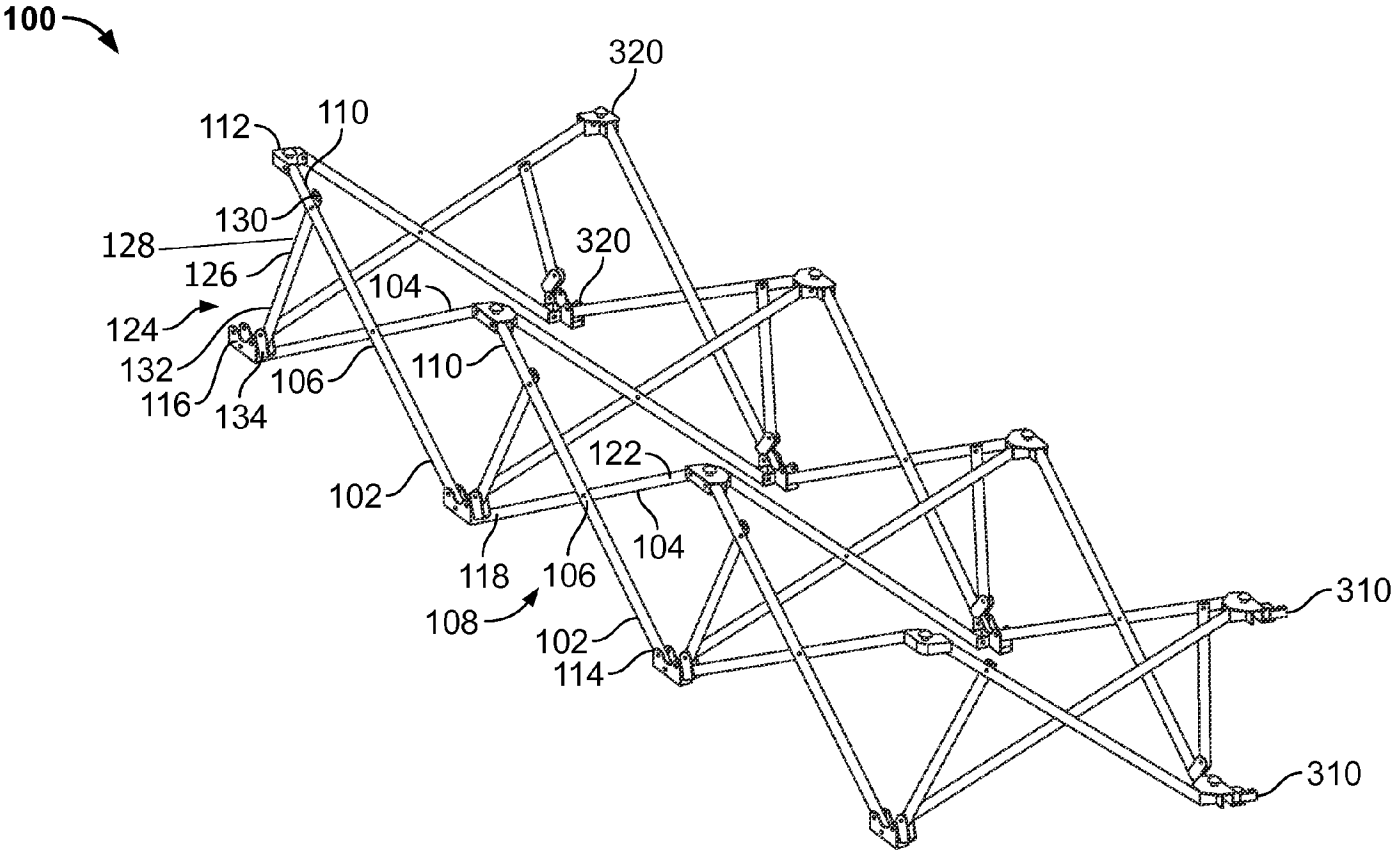
FIG. 2 is a perspective view of a frame of a first unit in an expanded bed configuration.

Referring further to FIG. 2, in one embodiment, first unit 100 includes a plurality of first frame members 102 pivotally coupled to a corresponding second frame member 104 at a pivot point or joint 106, such as at a midpoint of first frame member 102 and second frame member 104, to form a plurality of scissor assemblies 108. A pivot member, such as a bolt, screw or rivet, pivotally couples first frame member 102 to second frame member 104. Each first frame member 102 is pivotally coupled at or near a first end 110 to an upper connector assembly 112 and pivotally coupled at or near an opposing second end 114 to a lower connector assembly or foot 116. Each second frame member 104 is pivotally coupled at or near a first end 118 to a corresponding lower connector assembly 116 and pivotally coupled at or near an opposing second end 122 to a corresponding upper connector assembly 112. Upper connector assembly 112 and/or lower connector assembly 116 couple adjacent or cooperating first frame members 102 and second frame members 104 so there are no loose pieces to be gathered and assembled.

Figure 12:
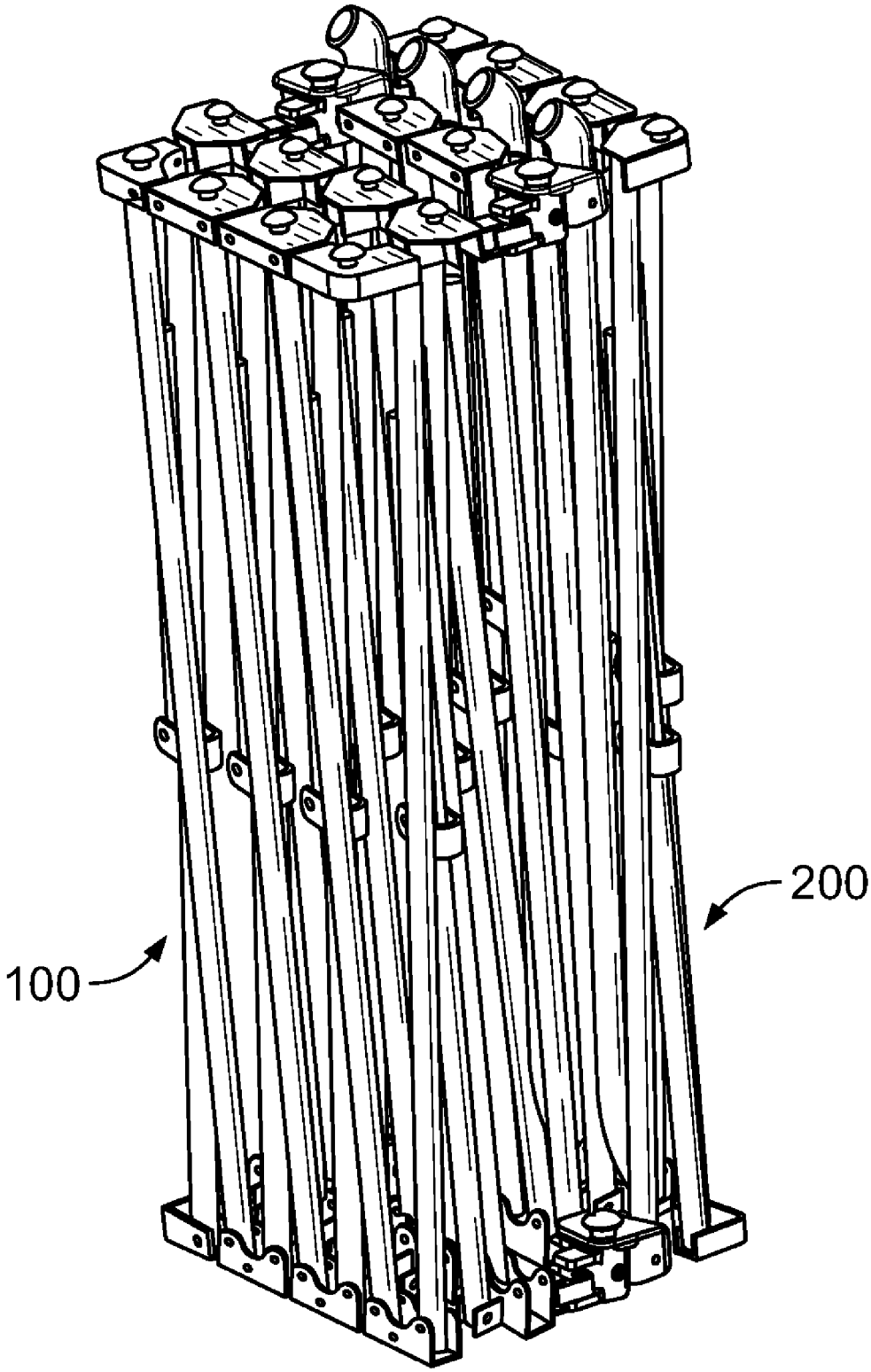
FIG. 12 is a perspective view of the coupled frames shown in FIG. 7 in a fully collapsed configuration.

Scissor assemblies 108 facilitate moving first unit 100 between the expanded configuration, such as shown in FIGS. 1 and 2, and the collapsed configuration, as shown in FIG. 12. More specifically, each scissor assembly 108 includes first frame member 102 pivotally coupled to corresponding second frame member 104 at pivot point 106. First unit 100 is moved towards the collapsed configuration as first frame member 102 moves or pivots with respect to second frame member 104 to urge first end 110 of first frame member 102 towards second end 122 of second frame member 104 to urge adjacent upper connector assemblies 112 together. Similarly, second end 114 of first frame member 102 is urged towards first end 118 of second frame member 104 to urge adjacent lower connector assemblies 116 together. Conversely, first unit 100 is moved from the collapsed configuration towards the expanded configuration as first frame member 102 moves or pivots with respect to second frame member 104 to urge first end 110 of first frame member 102 away from second end 122 of second frame member 104 to urge adjacent upper connector assemblies 112 apart. Similarly, second end 114 of first frame member 102 is urged away from first end 118 of second frame member 104 to urge adjacent lower connector assemblies 112 apart.

In one embodiment, a force directed at one or more corners of first unit 100 causes movement in other corners such that first unit 100 moves as a whole inwardly with respect to a central reference area of first unit 100 to facilitate moving first unit 100 to the collapsed configuration or outwardly relative to the central reference area to facilitate moving first unit 100 to the expanded configuration. Further, upper connector assemblies 112 and lower connector assemblies 116, as well as pivot points 106, allow first unit 100 to move as a unit when first unit 100 is collapsed and expanded. It should be apparent to those skilled in the art and guided by the teachings herein provided that one lower connector assembly 116 may remain substantially fixed or stationary as first unit 100 is collapsed or expanded, while the remaining lower connector assemblies 116 move inwardly or outwardly, respectively. As such, the central reference area may itself move. For example, when first unit 100 is located within a room such that one lower connector assembly 116 is positioned in a corner of the room, movement of first unit 100 is constrained. As first unit 100 moves towards the expanded configuration, the remaining non-constrained lower connector assemblies 116 expand outwardly from the central reference area as the central reference area itself moves outwardly with respect to the stationary lower connector assembly 116.

In one embodiment, one or more support assemblies 124 are operatively coupled to a corresponding scissor assembly 108. As shown in FIG. 2, support assembly 124 includes a member 126 coupled to first frame member 102 or second frame member 104 of corresponding scissor assembly 108 to facilitate retaining first unit 100 in the expanded configuration, as desired. As shown in FIG. 2, in one embodiment, member 126 is pivotally coupled to first frame member 102 between first end 110 and pivot point 106. In a particular embodiment, member 126 is pivotally coupled at a first end 128 to first frame member 102 at a pivot point 130. In a further embodiment, pivot point 130 is positioned at a distance from first end 110 equal to about ⅙ of a length of first frame member 102. In alternative embodiments, pivot point 130 is positioned at any suitable distance from first end 110 such that member 126 is operable as described herein.

Referring further to FIG. 2, member 126 is slidably coupled at an opposing second end 132 to corresponding second frame member 104 of scissor assembly 108 between corresponding lower connector assembly 116 and pivot point 106. In one embodiment, second end 132 is pivotally coupled to a collar 134 that is slidably positioned about second frame member 104. As first unit 100 is moved towards the expanded configuration, first end 128 pivots about pivot point 130 and second end 132 of member 126 moves along a length of second frame member 104 towards corresponding lower connector assembly 116. In one embodiment, with first unit 100 in the expanded configuration, second end 132 is secured to lower connector assembly 116 to facilitate retaining first unit 100 in the expanded configuration, as desired. In a particular embodiment, collar 134 is releasably secured, such as locked, into lower connector assembly 116 to secure second end 132 to lower connector assembly 116. It should be apparent to those skilled in the art and guided by the teachings herein provided that any suitable securing and/or locking mechanism may be incorporated to releasably secure second end 132 and/or collar 134 to lower connector assembly 116. In one embodiment, collar 134 is releasably press-fitted into lower connector assembly 116. In a further embodiment, member 126 or collar 134 forms a suitable projection that is fitted into or interferes with a cooperating void formed in lower connector assembly 116 to secure member 126 to lower connector assembly 116.

In order to move first unit 100 towards the collapsed configuration, second end 132 and/or collar 134 is unlocked from lower connector assembly 116. First end 128 pivots about pivot point 130 and second end 132 of member 126 moves along the length of second frame member 104 towards corresponding pivot point 106 as first unit 100 is moved towards the collapsed configuration. In alternative embodiments, member 126 is pivotally coupled to second frame member 104 between first end 118 and pivot point 106 and slidably coupled to corresponding first frame member 102 of scissor assembly 108 between corresponding upper connector assembly 112 and pivot point 106.

In an alternative embodiment, member 126 is pivotally coupled at first end 128 to upper connector assembly 112 and slidably coupled at opposing second end 132 to second frame member 104 of scissor assembly 108. In one embodiment, second end 132 is pivotally coupled to collar 134 that is slidably positioned about second frame member 104. As first unit 100 is moved towards the expanded configuration, second end 132 of member 126 moves along a length of second frame member 104 towards corresponding lower connector assembly 116. With first unit 100 in the expanded configuration, second end 132 is secured to lower connector assembly 116 to facilitate retaining first unit 100 in the expanded configuration, as desired. In a particular embodiment, collar 134 is locked into lower connector assembly 116 to secure second end 132 to lower connector assembly 116, such as described herein. In order to move first unit 100 towards the collapsed configuration, second end 132 and/or collar 134 is unlocked from lower connector assembly 116. Second end 132 of member 126 moves along the length of second frame member 104 towards corresponding pivot point 106 as first unit 100 is moved towards the collapsed configuration. In further alternative embodiments, member 126 is pivotally coupled to lower connector assembly 116 and slidably coupled to first frame member 102 of scissor assembly 108.

Figure 3:
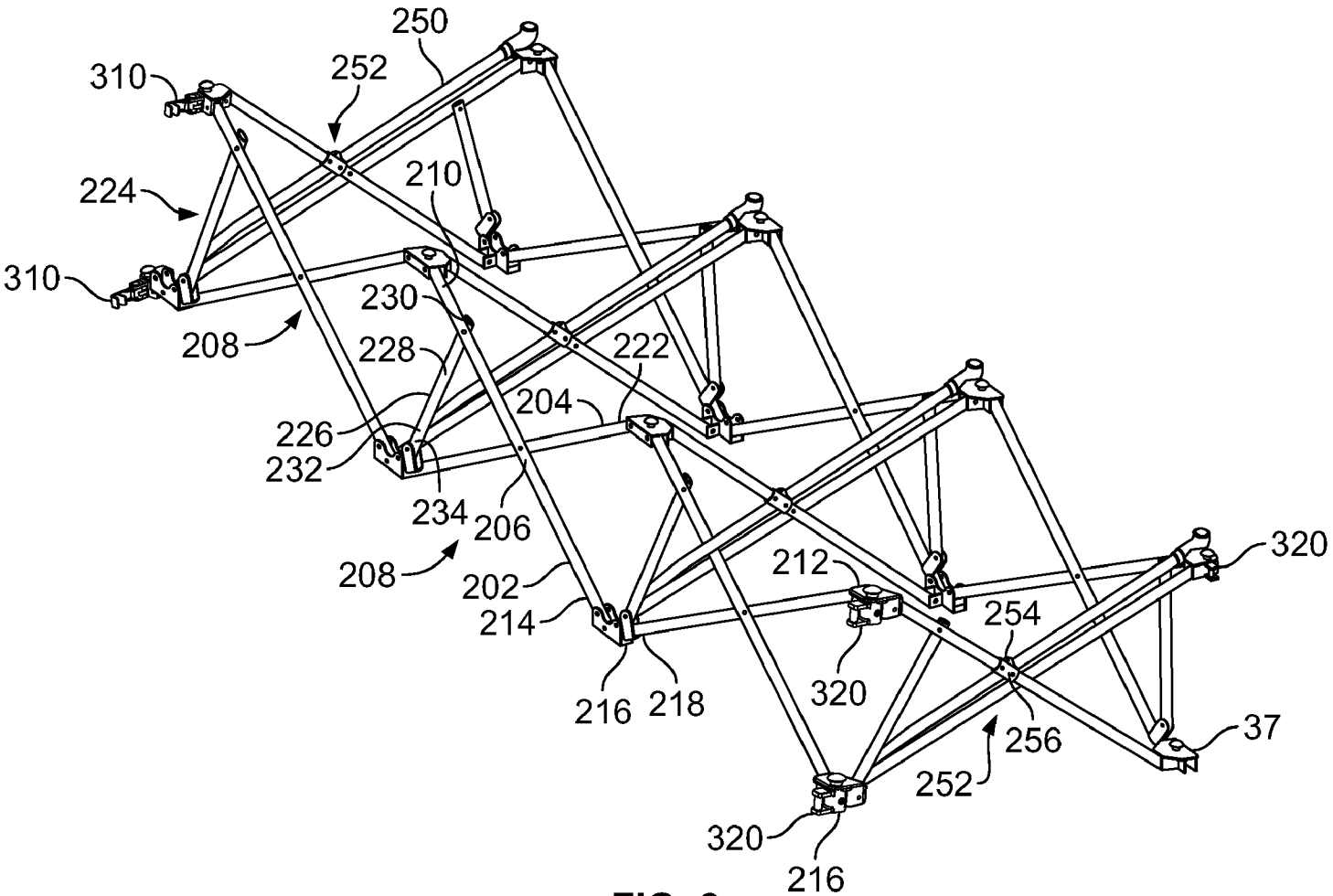
FIG. 3 is a perspective view of a frame of a second unit in an expanded bed configuration.

Referring to FIG. 3, in one embodiment, second unit 200 includes a plurality of frame members joined by pivot assemblies such that lower connector assemblies move laterally within a common horizontal plane as the frame as a whole expands outwardly from a central reference area to expand second unit 200 outwardly from the central reference area. Second unit 200 is urged outwardly from the central reference area, thus causing second unit 200 to expand outwardly as a whole from the central reference area and mattress 400 is inflated. In a particular embodiment, mattress 400 is coupled to second unit 200 at a plurality of attachment points such that as mattress 400 is inflated and expands outwardly, second unit 200 also expands outwardly. Mattress 400 may be coupled to second unit 200 with a fabric covering, which encloses at least a portion of mattress 400. The fabric covering is coupled to second unit 200 at a plurality of attachment points, for example at a plurality of upper connector assemblies, such that as mattress 400 is inflated and expands outwardly, the fabric covering expands outwardly, causing second unit 200 to also expand outwardly.

Referring further to FIG. 3, in one embodiment, second unit 200 includes a plurality of first frame members 202 pivotally coupled to a corresponding second frame member 204 at a pivot point or joint 206, such as at a midpoint of first frame member 202 and second frame member 204, to form a plurality of scissor assemblies 208. A pivot member, such as a bolt, screw or rivet, pivotally couples first frame member 202 to second frame member 204. Each first frame member 202 is pivotally coupled at or near a first end 210 to an upper connector assembly 212 and pivotally coupled at or near an opposing second end 214 to a lower connector assembly or foot 216. Each second frame member 204 is pivotally coupled at or near a first end 218 to a corresponding lower connector assembly 216 and pivotally coupled at or near an opposing second end 222 to a corresponding upper connector assembly 212. Upper connector assembly 212 and/or lower connector assembly 216 couple adjacent or cooperating first frame members 202 and second frame members 204 so there are no loose pieces to be gathered and assembled.

Scissor assemblies 208 facilitate moving second unit 200 between the expanded configuration, such as shown in FIGS. 1 and 2, and the collapsed configuration. More specifically, each scissor assembly 208 includes first frame member 202 pivotally coupled to corresponding second frame member 204 at pivot point 206. Second unit 200 is moved towards the collapsed configuration as first frame member 202 moves or pivots with respect to second frame member 204 to urge first end 210 of first frame member 202 towards second end 222 of second frame member 204 to urge adjacent upper connector assemblies 212 together. Similarly, second end 214 of first frame member 202 is urged towards first end 218 of second frame member 204 to urge adjacent lower connector assemblies 216 together. Conversely, second unit 200 is moved from the collapsed configuration towards the expanded configuration as first frame member 202 moves or pivots with respect to second frame member 204 to urge first end 210 of first frame member 202 away from second end 222 of second frame member 204 to urge adjacent upper connector assemblies 212 apart. Similarly, second end 214 of first frame member 202 is urged away from first end 218 of second frame member 204 to urge adjacent lower connector assemblies 212 apart.

In one embodiment, a force directed at one or more corners of second unit 200 causes movement in other corners such that second unit 200 moves as a whole inwardly with respect to a central reference area of second unit 200 to facilitate moving second unit 200 to the collapsed configuration or outwardly relative to the central reference area to facilitate moving second unit 200 to the expanded configuration, such as described above in reference to first unit 100. Further, upper connector assemblies 212 and lower connector assemblies 216, as well as pivot points 206, allow second unit 200 to move as a unit when second unit 200 is collapsed and expanded.

A support assembly 224 is operatively coupled to a corresponding scissor assembly 208. In one embodiment, support assembly 224 includes a member 226 coupled to one or more scissor assemblies 208 to facilitate retaining second unit 200 in the expanded configuration, as desired. As shown in FIG. 3, in one embodiment, member 226 is pivotally coupled to first frame member 202 between first end 210 and pivot point 206. In a particular embodiment, member 226 is pivotally coupled at a first end 228 to first frame member 202 at a pivot point 230. In a further embodiment, pivot point 230 is positioned at a distance from first end 210 equal to about ⅙ of a length of first frame member 202. In alternative embodiments, pivot point 230 is positioned at any suitable distance from first end 210 such that member 226 is operable as described herein.

Referring further to FIG. 3, member 226 is slidably coupled at an opposing second end 232 to corresponding second frame member 204 of scissor assembly 208 between corresponding lower connector assembly 216 and pivot point 206. In one embodiment, second end 232 is pivotally coupled to a collar 234 that is slidably positioned about second frame member 204. As second unit 200 is moved towards the expanded configuration, first end 228 pivots about pivot point 230 and second end 232 of member 226 moves along a length of second frame member 204 towards corresponding lower connector assembly 216. In one embodiment, with second unit 200 in the expanded configuration, second end 232 is secured to lower connector assembly 216 to facilitate retaining second unit 200 in the expanded configuration, as desired. In a particular embodiment, collar 234 is releasably secured, such as locked, into lower connector assembly 216 to secure second end 232 to lower connector assembly 216. It should be apparent to those skilled in the art and guided by the teachings herein provided that any suitable securing and/or locking mechanism may be incorporated to releasably secure second end 232 and/or collar 234 to lower connector assembly 216. In one embodiment, collar 234 is releasably press-fitted into lower connector assembly 216. In a further embodiment, member 226 or collar 234 forms a suitable projection that is fitted into or interferes with a cooperating void formed in lower connector assembly 216 to secure member 226 to lower connector assembly 216.

In order to move second unit 200 towards the collapsed configuration, second end 232 and/or collar 234 is unlocked from lower connector assembly 216. First end 228 pivots about pivot point 230 and second end 232 of member 226 moves along the length of second frame member 204 towards corresponding pivot point 206 as second unit 200 is moved towards the collapsed configuration. In alternative embodiments, member 226 is pivotally coupled to second frame member 204 between first end 218 and pivot point 206 and slidably coupled to corresponding first frame member 202 of scissor assembly 208 between corresponding upper connector assembly 212 and pivot point 206.

In an alternative embodiment, member 226 is pivotally coupled at first end 228 to upper connector assembly 212 and slidably coupled at opposing second end 232 to second frame member 204 of scissor assembly 208. In one embodiment, second end 232 is pivotally coupled to collar 234 that is slidably positioned about second frame member 204. As second unit 200 is moved towards the expanded configuration, second end 232 of member 226 moves along a length of second frame member 204 towards corresponding lower connector assembly 216. With second unit 200 in the expanded configuration, second end 232 is secured to lower connector assembly 216 to facilitate retaining second unit 200 in the expanded configuration, as desired. In a particular embodiment, collar 234 is locked into lower connector assembly 216 to secure second end 232 to lower connector assembly 216, such as described herein. In order to move second unit 200 towards the collapsed configuration, second end 232 and/or collar 234 is unlocked from lower connector assembly 216. Second end 232 of member 226 moves along the length of second frame member 204 towards corresponding pivot point 206 as second unit 200 is moved towards the collapsed configuration. In further alternative embodiments, member 226 is pivotally coupled to lower connector assembly 216 and slidably coupled to first frame member 202 of scissor assembly 208.

Figure 7:
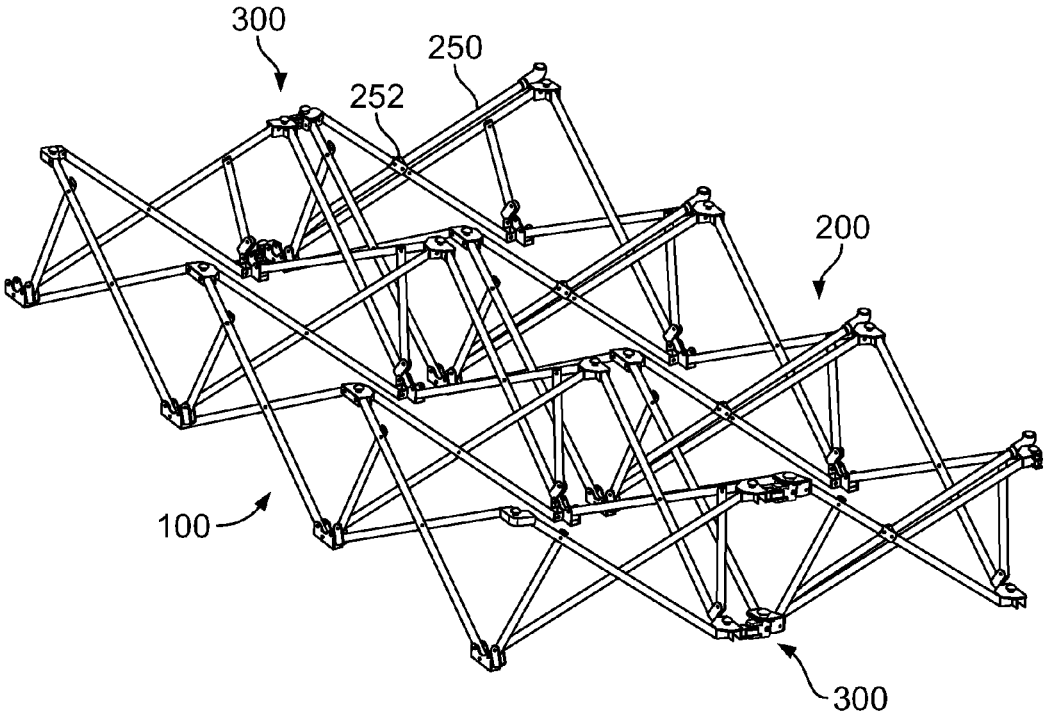
FIG. 7 is a perspective view of a frame of the first unit in an expanded configuration coupled to a frame of the second unit in an expanded bed configuration to form a large bed frame.
Figure 9:
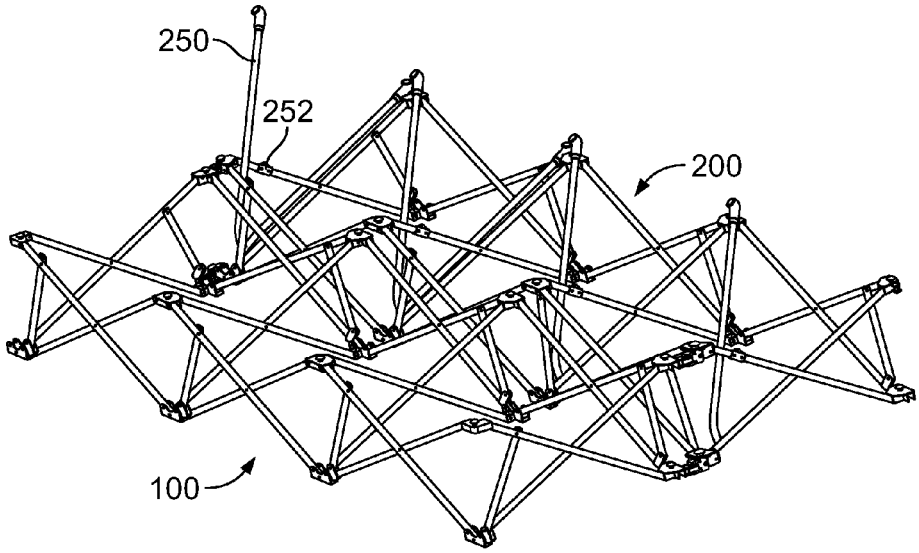
FIG. 9 is a perspective view of the frame of the first unit in an expanded configuration coupled to the frame of the second unit in an expanded sofa configuration to form a sofa bed frame.
Figure 10:
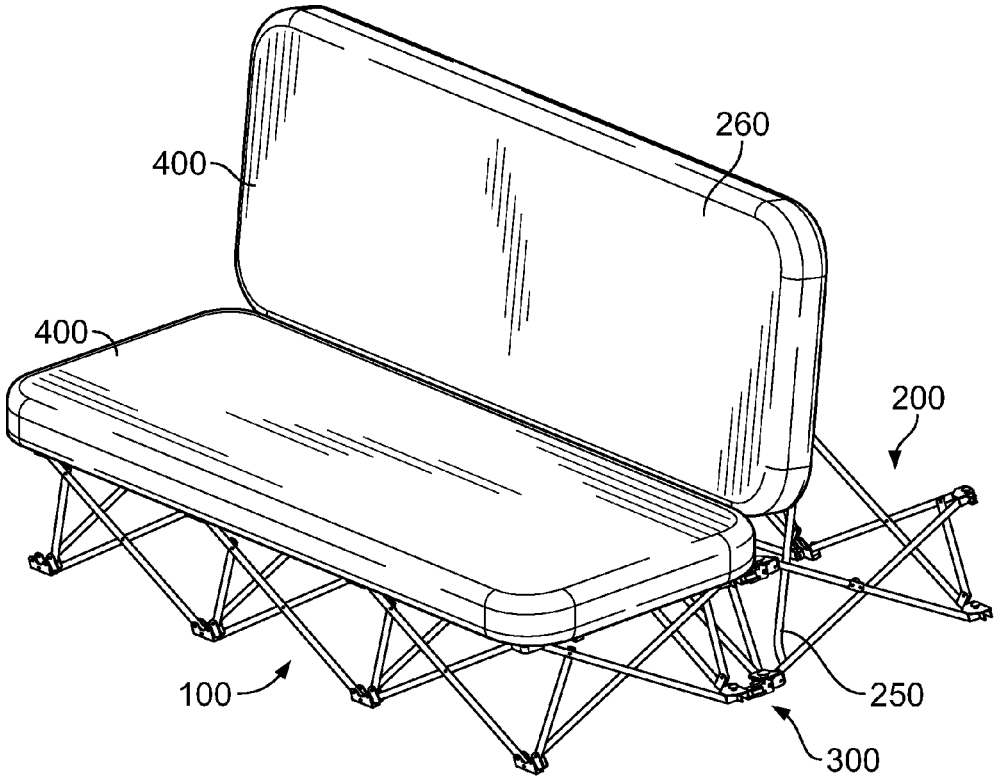
FIG. 10 is a perspective view of a bed assembly including the coupled frames shown in FIG. 9.
Figure 11:
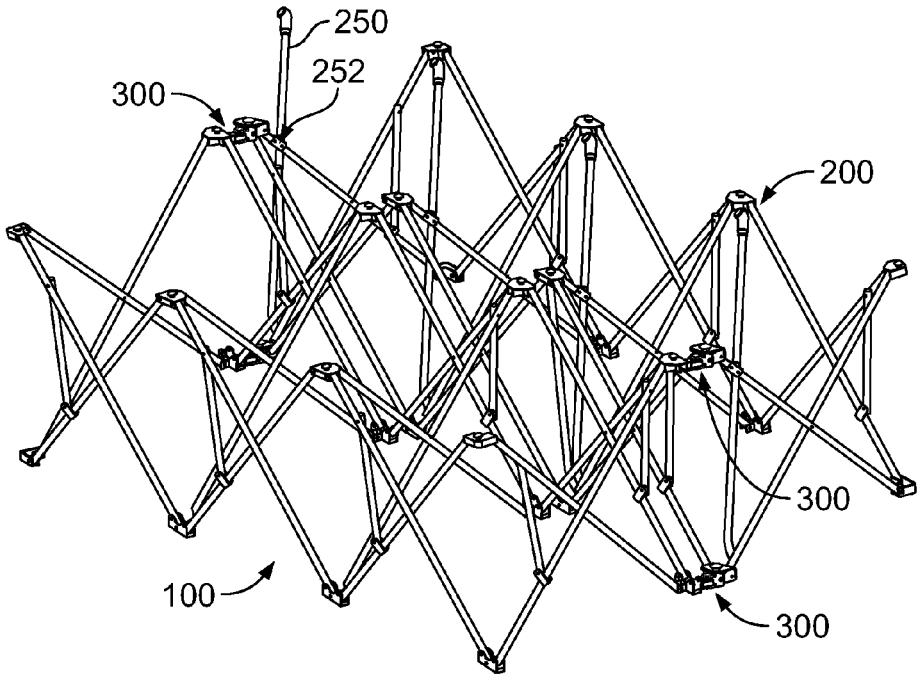
FIG. 11 is a perspective view of the coupled frames shown in FIG. 7 in a partially collapsed configuration.

In one embodiment, second unit 200 includes a plurality of support rods 250 for supporting mattress 400 in a sofa configuration, as shown in FIG. 10. A linking mechanism 252 slidably couples each support rod 250 to a first frame member 202 or a second frame member 204 of a cooperating scissor assembly 208. In one embodiment, linking mechanism 252 includes a first segment 254 slidably positioned about support rod 250 and a second segment 256 pivotally coupled to first segment 254 and slidably positioned about a corresponding first frame member 202, for example. A lower end 258 of support rod 250 is pivotally coupled to a corresponding lower connector assembly 216. Referring to FIGS. 7 and 9, support rod 250 is pivotally movable from a first position with second unit 200 in a first or bed configuration, as shown in FIG. 7, in which support rod 250 is positioned generally adjacent and parallel to corresponding first frame member 202, and a second or extended position with second unit 200 in a second or sofa configuration, as shown in FIG. 9, in which support rod 250 extends upwardly from corresponding lower connector assembly 216.

With second unit 200 in the bed configuration, movement of linking mechanism 252 along first frame member 202 is limited at pivot point 206. With second unit 200 in the sofa configuration, a locking mechanism releasably locks support rod 250 in the extended position. In one embodiment, the locking mechanism releasably locks linking mechanism 252 to a corresponding upper connector assembly 212 to maintain support rod 250 in the extended position. In the extended position, support rods 250 support mattress 400 in an inclined or angled planar position to form or define a back rest 260, as shown in FIG. 10.

In a particular embodiment, a locking aperture is defined within upper connector assembly 212 and is configured to receive a pin that movably extends from linking mechanism 252. As support rods 250 rotate upward and away from corresponding first frame member 202, linking mechanism 252 slides upward along a length of support rod 250. When the pin reaches the locking aperture defined within upper connector assembly 212, the pin extends into the locking aperture under a spring biasing force and, thus, locks the support rod 250 in the extended position such that bed assembly 10 is in the sofa configuration. In a particular embodiment, linking mechanism 252 may be locked at one of a plurality of positions along a length of support rod 250. In a further embodiment, the locking mechanism is configured to secure linking mechanism 252 in a desired position along a length of first frame member 202. In this embodiment, first frame member 202 defines a plurality of locking apertures, and the locking mechanism includes a pin extending into one locking aperture to secure linking mechanism 252 to first frame member 202.

In one embodiment, mattress 400 is coupled along a first edge to a first row of upper connector assemblies 212 of second unit 200 and coupled along a laterally opposing second edge to an upper end of support rods 250.

Figure 4:
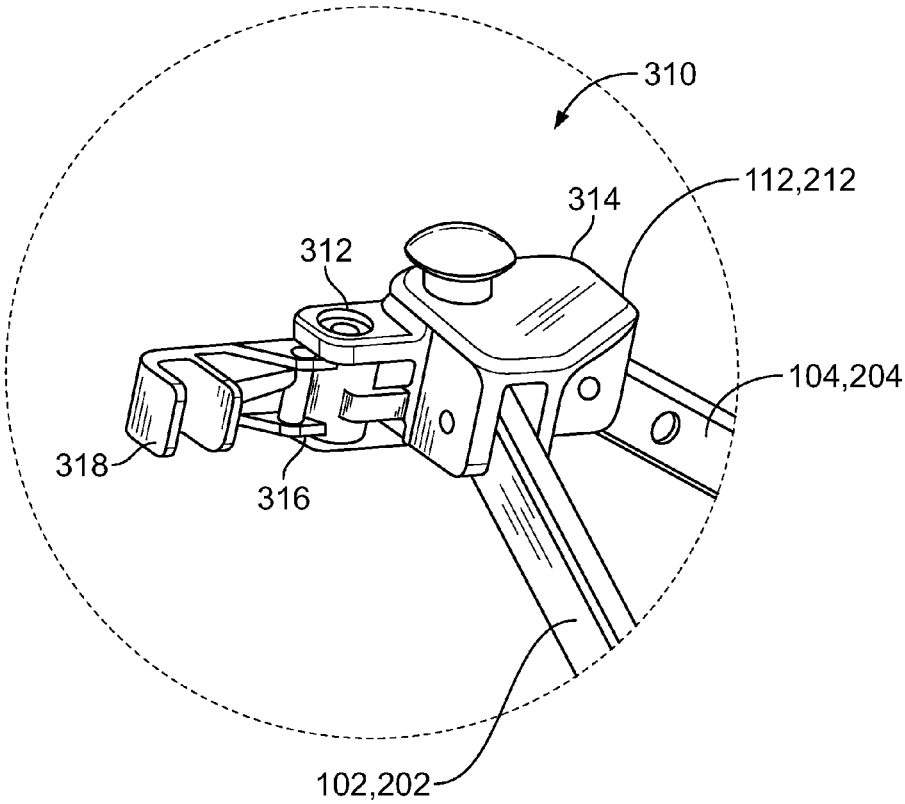
FIG. 4 is a perspective view of a first coupler coupled to an upper connector assembly.
Figure 5:
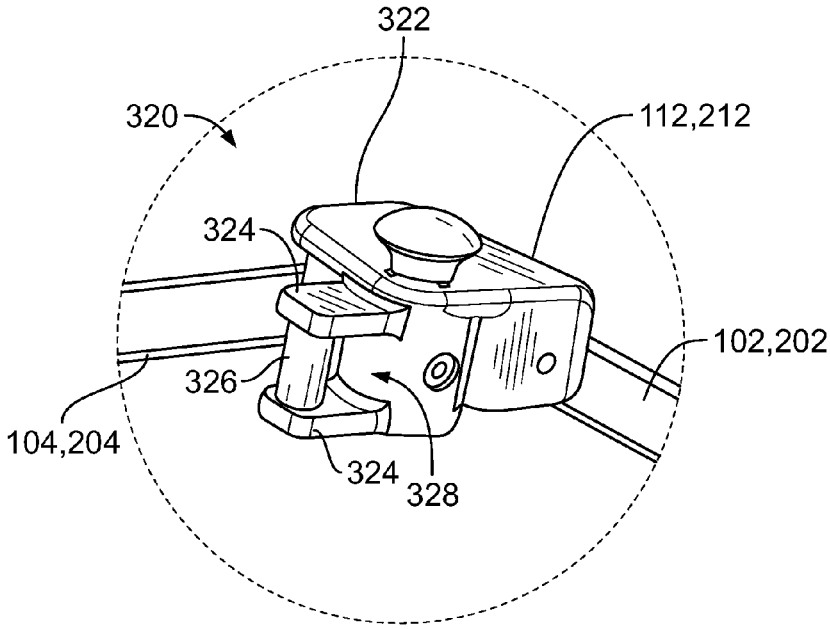
FIG. 5 is a perspective view of a second coupler coupled to an upper connector assembly.
Figure 6:
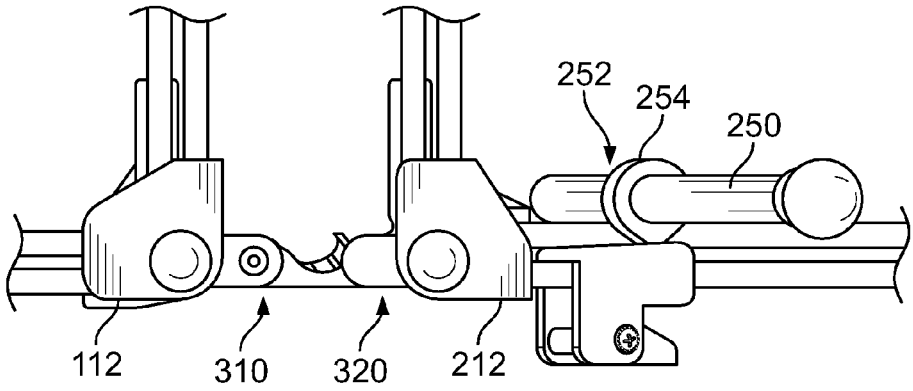
FIG. 6 is a top view of a first coupler coupled to a second coupler.

Referring to FIGS. 4-6, in one embodiment, first unit 100 is releasably coupled to second unit 200 to form bed assembly 10. In one embodiment, assembly unit 300 includes a first coupler 310, shown in FIG. 4, and a second coupler 320, shown in FIG. 5. One or more first couplers 310 are coupled to or integrated with a corresponding upper connector assembly 112 and/or a corresponding lower connector assembly 116 of first unit 100. Similarly, one or more second couplers 320 are coupled to or integrated with a corresponding upper connector assembly 212 and/or a corresponding lower connector assembly 216 of second unit 200 to cooperate with a corresponding first coupler 112 of first unit 100. Alternatively, or in addition, one or more second couplers 320 are coupled to or integrated with a corresponding upper connector assembly 112 and/or a corresponding lower connector assembly 116 of first unit 100 and one or more first couplers 310 are coupled to or integrated with a corresponding upper connector assembly 212 and/or a corresponding lower connector assembly 216 of second unit 200 to cooperate with a corresponding second coupler 312 of first unit 100.

Figure 8:
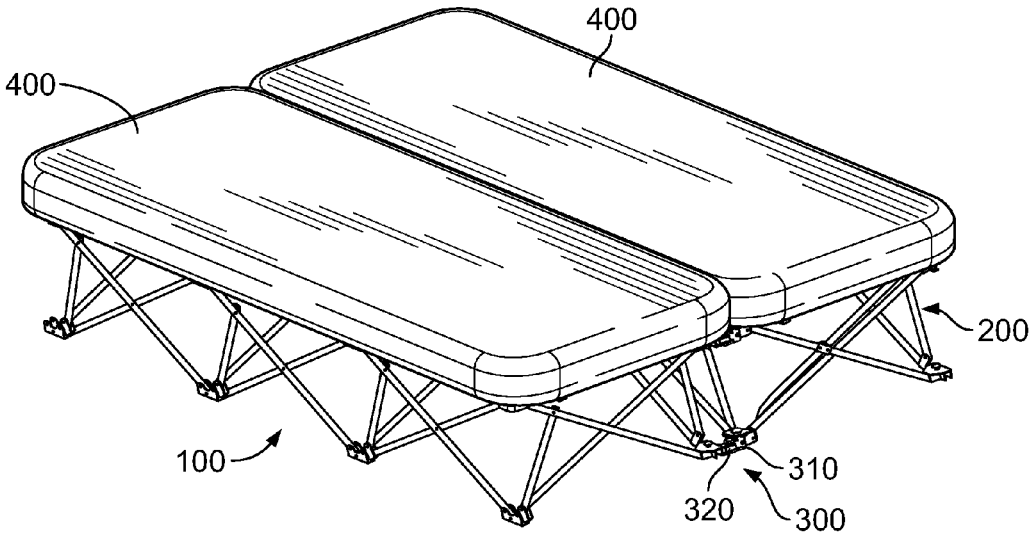
FIG. 8 is a perspective view of a bed assembly including the coupled frames shown in FIG. 7.

As shown in FIG. 4, in one embodiment first coupler 310 includes a positioning section 312 coupled to upper connector assembly 112 or lower connector assembly 116. A central section 316 is rotatably coupled to positioning section 312 where positioning section 312 extends outward from upper connector assembly 112 or lower connector assembly 116. A U-shaped hitch 318 is formed at an end of central section 316. Second coupler 320 includes a fixed section 322 coupled to or integrated with upper connector assembly 212 or lower connector assembly 216. Two flanges 324 extend outward from an upper end and a lower end of fixed section 322. A positioning pillar 326 is fixed between flanges 324. An opening 328 is defined between positioning pillar 326 and fixed section 322 to receive at least a portion of hitch 318. Hitch 318 and positioning pillar 326 cooperate to form a detachable or releasable coupling mechanism configured to releasably couple first unit 100 to second unit 200. When first unit 100 and second unit 200 are decoupled, each of first unit 100 and second unit 200 form a full size or twin size bed, such as shown in FIG. 1. With first unit coupled to second unit, and with support rods 250 in the first position, first unit 100 and second unit 200 form a larger bed assembly, such as a queen size bed assembly, as shown in FIG. 8. With first unit coupled to second unit, and with support rods 250 in the second or extended position, first unit 100 and second unit 200 form a sofa bed assembly, as shown in FIG. 10.

In one embodiment, a method for assembling a collapsible frame assembly includes forming a collapsible first frame having a plurality of first scissor assemblies. Each first scissor assembly includes a first frame member pivotally coupled to a second frame member at a pivot point. Frame members of adjacent first scissor assemblies are coupled to a first upper connector assembly or a first lower connector assembly. A collapsible second frame is formed that includes a plurality of second scissor assemblies. Each second scissor assembly includes a first frame member pivotally coupled to a second frame member at a pivot point. Frame members of adjacent second scissor assemblies are coupled to a second upper connector assembly or a second lower connector assembly. The first unit is removably coupled to the second unit.

The bed assembly as described herein provides a collapsible and convertible bed assembly having two or more units that can be disassembled or decoupled to provide two or more smaller beds to meet the user's needs. Each unit includes a collapsible frame and a mattress operatively coupled to the frame. Each frame includes a plurality of scissor assemblies coupled together at upper connector assemblies and lower connector assemblies.

The present disclosure provides a foldable or collapsible sofa bed assembly that is configurable in a bed configuration or a sofa configuration. Further, the sofa bed assembly is fully collapsible. The sofa bed includes at least two units having foldable or collapsible frames including a plurality of scissor assemblies. Adjacent frame members of each scissor assembly are coupled together at an upper end and a lower end of each frame member. A plurality of support rods are positioned along a longitudinal line defined along a length of the second unit frame. Each support rod is pivotally coupled at a lower end to a lower portion of a frame member and/or a lower connector assembly, and an upper end of each support rod is selectively positioned adjacent a corresponding frame member or pivotally movable with respect to the frame member to extend upward from a planar support area defined by the frame. A mattress and/or a fabric covering is coupled at a first or front edge portion to a front upper connector assembly of the second unit frame and a second or rear edge portion is coupled to the upper ends of the support rods.

The above-described sofa bed assembly having at least two units each including a foldable or collapsible and convertible frame facilitates providing a sleeping area or a seating area quickly and efficiently. More specifically, the collapsible frames are movable between a collapsed configuration, facilitating storage and/or transportation of the sofa bed, and an expanded configuration. In the expanded configuration the two or more units are coupled together in a bed configuration or a sofa configuration to define a support structure configured to support a mattress and one or more users. Further, at least one unit frame is movable between the bed configuration and the sofa configuration easily and efficiently, as desired.

Exemplary embodiments of a sofa bed assembly including a foldable or collapsible and convertible frame and a method for constructing a sofa bed assembly are described above in detail. The apparatus and method are not limited to the specific embodiments described herein but, rather, components of the apparatus and/or steps of the method may be utilized independently and separately from other components and/or steps described herein. Further, the described apparatus components and/or method steps can also be defined in, or used in combination with, other apparatus and/or methods, and are not limited to practice with only the apparatus and method as described herein.

While the disclosed furniture assembly has been described in terms of various specific embodiments, those skilled in the art will recognize that the invention can be practiced with modification within the spirit and scope of the claims.

What is claimed is:

1. A collapsible and convertible furniture assembly movable between an expanded configuration and a collapsed configuration, the collapsible and convertible furniture assembly comprising:

a first unit comprising a first frame including a plurality of first scissor assemblies, a first plurality of assembly units, and at least one support member, each first scissor assembly of the plurality of first scissor assemblies comprising a first frame member pivotally coupled to a second frame member at a pivot point, frame members of adjacent first scissor assemblies coupled to one of a first upper connector assembly and a first lower connector assembly, the at least one support member comprising a first end pivotally coupled to one of the first frame members between a first upper connector assembly and a pivot point of a corresponding first scissor assembly;

a second unit removably coupled to the first unit along a longitudinal axis, at least one of the first unit and the second unit pivotable about the longitudinal axis, the second unit comprising a second frame including a plurality of second scissor assemblies and a second plurality of assembly units, each second scissor assembly of the plurality of second scissor assemblies comprising a first frame member pivotally coupled to a second frame member at a pivot point, frame members of adjacent second scissor assemblies coupled directly to and contacting one of a second upper connector assembly and a second lower connector assembly, the first and second pluralities of assembly units configured to removably couple the first unit to the second unit; and at least two support rods coupled to the second frame, each support rod of the at least two support rods slidably coupled to a corresponding first frame member of the second frame and having a lower end pivotally coupled to a corresponding second lower connector assembly of the second frame, each support rod pivotally movable with respect to a corresponding second frame member.

2. A collapsible and convertible furniture assembly in accordance with claim 1 wherein, in a first position, each support rod is positioned adjacent the corresponding second frame member.

3. A collapsible and convertible furniture assembly in accordance with claim 2 wherein, in a second position, each support rod extends upwardly from the second frame to position the second unit at an inclined position with respect to the first unit.

4. A collapsible and convertible furniture assembly in accordance with claim 3 wherein, in the second position, each support rod is coupled to a corresponding second upper connector assembly.

5. A collapsible and convertible furniture assembly in accordance with claim 1 further comprising a linking mechanism slidably coupling each support rod to the corresponding first frame member, the linking mechanism further comprising:

a first segment slidably positioned about the support rod; and a second segment pivotally coupled to the first segment and slidably positioned about the corresponding first frame member.

6. A collapsible and convertible furniture assembly in accordance with claim 5 wherein, with the support rod positioned adjacent the corresponding second frame member, the second segment is seated against the pivot point.

7. A collapsible and convertible furniture assembly in accordance with claim 5 further comprising a locking mechanism configured to secure the linking mechanism in a desired position along a length of the corresponding first frame member, wherein the first frame member defines a plurality of locking apertures, and the locking mechanism comprises a pin extending into a first aperture of the plurality of apertures to secure the linking mechanism to the corresponding first frame member.

8. A collapsible and convertible furniture assembly in accordance with claim 7 further comprising a spring biasing the pin to extend outwardly from the second segment and into the first aperture.

9. A collapsible and convertible furniture assembly in accordance with claim 1 further comprising a mattress coupled along a first edge to a first row of the second upper connector assemblies of the second frame and coupled along a laterally opposing second edge to the at least two support rods.

10. A collapsible and convertible furniture assembly in accordance with claim 9 further comprising a mattress coupled along a first edge to a first row of the first upper connector assemblies of the first frame and coupled along a laterally opposing second edge to a second row of the first upper connector assemblies of the first frame.

11. A collapsible and convertible furniture assembly in accordance with claim 1 wherein, each of the first plurality of assembly units comprises a first coupler operatively coupled to one of a corresponding first upper connector assembly and a corresponding first lower connector assembly, and each of the second plurality of assembly units comprises a second coupler operatively coupled to one of a corresponding second upper connector assembly and a corresponding second lower connector assembly, the first and second pluralities of assembly units configured to removably couple the first unit to the second unit utilizing the first and second couplers.

12. A collapsible and convertible furniture assembly in accordance with claim 1, wherein the at least one support member further comprises a second end slidably coupled to a second frame member of the corresponding first scissor assembly.

13. A collapsible and convertible frame assembly movable between an expanded configuration and a collapsed configuration, the collapsible and convertible frame assembly comprising:

a first unit comprising a first frame including a plurality of first scissor assemblies and at least one support member, each first scissor assembly of the plurality of first scissor assemblies comprising a first frame member pivotally coupled to a second frame member at a pivot point, frame members of adjacent first scissor assemblies coupled to one of a first upper connector assembly and a first lower connector assembly, the at least one support member comprising a first end pivotally coupled to one of the first frame members between a first upper connector assembly and a pivot point of a corresponding first scissor assembly;

a second unit removably coupled to the first unit along a longitudinal axis, at least one of the first unit and the second unit pivotable about the longitudinal axis, the second unit comprising a second frame including a plurality of second scissor assemblies, each second scissor assembly of the plurality of second scissor assemblies comprising a first frame member pivotally coupled to a second frame member at a pivot point, frame members of adjacent second scissor assemblies coupled directly to and contacting one of a second upper connector assembly and a second lower connector assembly;

at least two support rods coupled to the second frame, each support rod of the at least two support rods slidably coupled to a corresponding first frame member and having a lower end pivotally coupled to a corresponding second lower connector assembly, each support rod pivotally movable with respect to a corresponding second frame member; and a plurality of assembly units removably coupling the first unit to the second unit, each of the plurality of assembly units comprising a first coupler and a second coupler.

14. A collapsible and convertible frame assembly in accordance with claim 13 wherein the first coupler is operatively coupled to one of a corresponding first upper connector assembly and a corresponding first lower connector assembly and the second coupler is operatively coupled to one of a corresponding second upper connector assembly and a corresponding second lower connector assembly.

15. A collapsible and convertible frame assembly in accordance with claim 14 wherein the first coupler comprises:

a positioning section coupled to the one of the corresponding first upper connector assembly and the corresponding first lower connector assembly;

a central section rotatably coupled to the positioning section, the central section extending from the positioning section; and a hitch formed at an end of the central section.

16. A collapsible and convertible frame assembly in accordance with claim 15 wherein the second coupler comprises:

a fixed section coupled to the one of the corresponding second upper connector assembly and the corresponding second lower connector assembly;

a first flange extending from an upper end of the fixed section and a second flange extending from a lower end of the fixed section; and a positioning pillar fixed between the first flange and the second flange, the hitch configured to couple to the positioning pillar to releasably couple the first unit to the second unit.

17. A collapsible and convertible frame assembly in accordance with claim 13 wherein, with the first unit decoupled from the second unit, each of the first unit and the second unit forms a bed.

18. A collapsible and convertible frame assembly in accordance with claim 13 wherein, with the first unit coupled to the second unit, the collapsible and convertible frame assembly is movable between a bed configuration and a sofa configuration.

19. A sofa bed comprising:

a collapsible and convertible frame assembly in accordance with claim 13;

a first mattress operatively coupled to the first frame; and a second mattress operatively coupled to the second frame.

20. A method for assembling a collapsible frame assembly, the method comprising:

forming a collapsible first frame comprising a plurality of first scissor assemblies, a first plurality of assembly units, and at least one support member, each first scissor assembly of the plurality of first scissor assemblies comprising a first frame member pivotally coupled to a second frame member at a pivot point, frame members of adjacent first scissor assemblies coupled to one of a first upper connector assembly and a first lower connector assembly, the at least one support member comprising a first end pivotally coupled to one of the first frame members between a first upper connector assembly and a pivot point of a corresponding first scissor assembly;

forming a collapsible second frame comprising a plurality of second scissor assemblies and a second plurality of assembly units, each second scissor assembly of the plurality of second scissor assemblies comprising a first frame member pivotally coupled to a second frame member at a pivot point, frame members of adjacent second scissor assemblies coupled directly to and contacting one of a second upper connector assembly and a second lower connector assembly, at least two support rods coupled to the collapsible second frame, each support rod of the at least two support rods slidably coupled to a corresponding first frame member of the collapsible second frame and having a lower end pivotally coupled to a corresponding second lower connector assembly of the collapsible second frame, each support rod pivotally movable with respect to a corresponding second frame member; and removably coupling the first and second pluralities of assembly units along a longitudinal axis to removably couple the collapsible first frame to the collapsible second frame, at least one of the first frame and the second frame pivotable about the longitudinal axis.

* * * * *